US007342160B2

(12) United States Patent
Alberti

(10) Patent No.: US 7,342,160 B2
(45) Date of Patent: Mar. 11, 2008

(54) ADJUSTABLE SUPPORT FOR A STRINGED MUSICAL INSTRUMENT

(76) Inventor: John L. Alberti, Windstone Editions, 13012 Saticoy St., Unit 3, North Hollywood, CA (US) 91605

( * ) Notice: Subject to any disclaimer, the term of this patent is extended or adjusted under 35 U.S.C. 154(b) by 186 days.

(21) Appl. No.: 11/113,417

(22) Filed: Apr. 23, 2005

(65) Prior Publication Data

US 2005/0235806 A1 Oct. 27, 2005

Related U.S. Application Data

(60) Provisional application No. 60/565,270, filed on Apr. 23, 2004.

(51) Int. Cl.
*G10D 1/02* (2006.01)

(52) U.S. Cl. ..... 84/280

(58) Field of Classification Search ..... 84/280, 84/327, 281

See application file for complete search history.

(56) References Cited

U.S. PATENT DOCUMENTS

| | | | | |
|---|---|---|---|---|
| 2,498,459 A * | 2/1950 | Schroetter | ..... | 84/280 |
| 2,974,556 A * | 3/1961 | Fawick | ..... | 84/280 |
| 4,037,505 A * | 7/1977 | Maples | ..... | 84/280 |

* cited by examiner

*Primary Examiner*—Kimberly Lockett
(74) *Attorney, Agent, or Firm*—Cherskov & Flaynik

(57) ABSTRACT

An adjustable support 12 for a stringed musical instrument such as a cello 10 includes a shaft 14 that is removably inserted into the cello 10, and a support member 16 that is adjustably disposed upon and secured to the shaft 14. The support member 16 includes an insertion portion 26 with a stabilizing bushing 72 disposed thereupon for stabilized insertion into an aperture in a bottom portion 11 of the cello 10, an annular portion 28 with an annular wall 34 for engaging and supporting the bottom portion 11 of the cello 10, and a lower portion 30 for securing the support member 16 circumferentially about a cylindrical outer wall 18 of the shaft thereby allowing an artist playing the cello to select a comfortable elevated and stabilized position of the cello 10 above a floor surface.

21 Claims, 2 Drawing Sheets

FIG. 1a
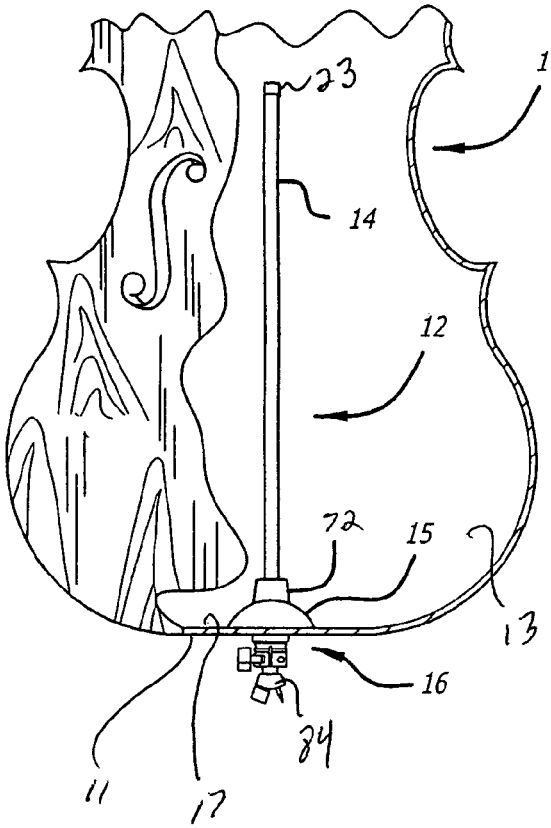
FIG. 1b
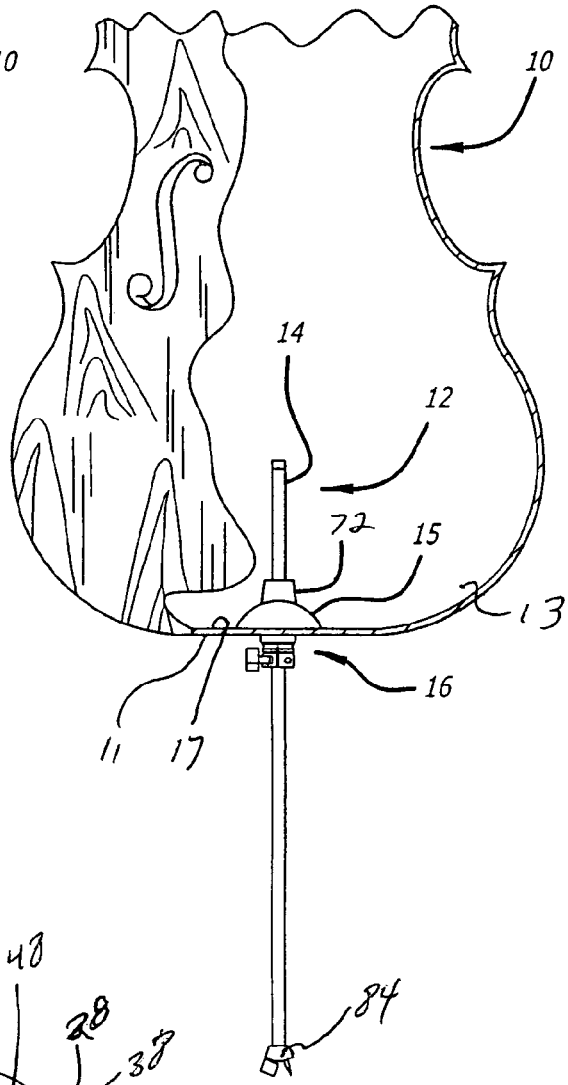
FIG. 4a
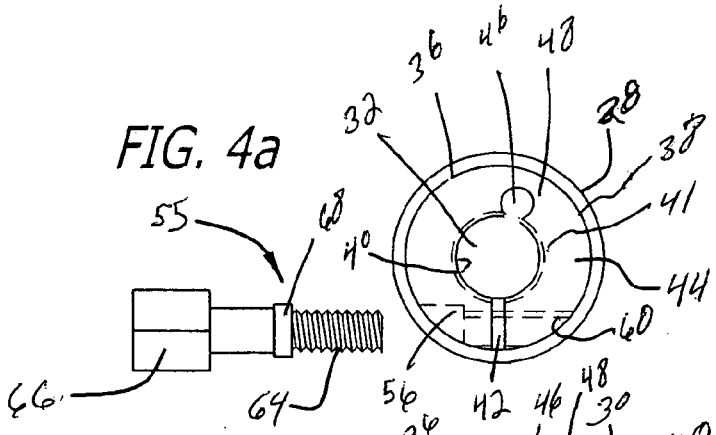
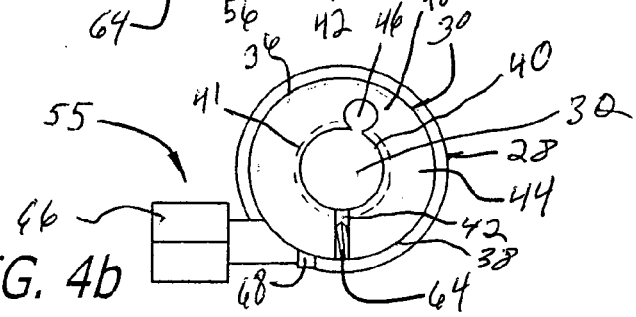
FIG. 4b

ADJUSTABLE SUPPORT FOR A STRINGED MUSICAL INSTRUMENT

This application is based on U.S. Provisional Application No. 60/565,270, filed on Apr. 23, 2004.

BACKGROUND OF THE INVENTION

1. Field of the Invention

The present invention relates to musical instrument supports and more particularly, to an adjustable support for a stringed musical instrument such as a cello, the adjustable support being secured to a bottom portion of the instrument.

2. Background of the Prior Art

Large stringed musical instruments, such as the cello or bass violin, require a support mechanism that elevates the instrument above a floor or other support surface suitable for facilitating the playing of the instrument. Such an arrangement is provided primarily for the comfort and assistance of the musician.

Commonly, the instrument is lifted and suspended from the support by means of a rod fixed to it. The rod is aligned in the centerline of the instrument to protrude from the bottom as the instrument is held inclined back from upright during performance. The length of the protruding portion of the shaft is generally adjustable to accommodate the preferences of the performer or artist.

The addition of such structure to the instrument necessarily redefines the instrument in terms of performance. As the instrument has been designed without particular reference to the support structure, it is desirable that the support structure have no negative effect upon performance.

Common instrument support structures generally include an elongated shaft that terminates in a sharp tip or spike for stabilizing the position of the instrument with respect to a support surface. The shaft is mounted longitudinally with respect to the instrument and extensible along the longitudinal axis. The extensible length of the shaft is secured by a clamp fixed to the bottom of the instrument.

The addition of such a structure to a cello or like instrument poses numerous design issues. These include, for example, the prevention of clamp slippage of a heavy stringed instrument such as a cello with respect to the support shaft, the eventual blunting of the tip of the endpin that can lead to instrument slippage, endpin alignment and extension for optimum performer comfort, loosening or lateral play of the structure or its parts that can introduce rattle and undesired vibrations that interfere with instrument tone and musical quality.

The above and other problems introduced by the addition of a support structure to a cello or like stringed instrument are addressed in a number of United States Patents including, for example, U.S. Ser. No. 620,393 of Whitton covering "Adjustable Extension-rod for Violoncellos or Other Musical Instruments"; U.S. Pat. No. 2,498,459 of Schroetter for "Support For Violin-Cellos"; U.S. Pat. No. 4,037,505 of Maples for "Adjustable End Pin For String Bass or Cello"; U.S. Pat. No. 4,586,418 of Stahlhammer for "Adjustable End Pin For the Cello"; and U.S. Pat. No. 5,819,959 of Kagan for "Reversible Carbide-Tipped Endpin."

A need exists for an adjustable support for a stringed musical instrument that includes a support member with an inner wall that circumferentially engages a support shaft without any other components of the adjustable support engaging the support shaft whereby an elevated position of the stringed musical instrument is maintained relative to a floor surface while maintaining tonal qualities of the instrument. Further, a need exists for an adjustable support that "grips" a portion of a floor surface that the instrument elevating shaft ultimately sets upon.

SUMMARY OF THE INVENTION

It is an object of the present invention to overcome many of the disadvantages associated with supports for stringed musical instruments.

A principle object of the present invention is to provide an adjustable support for a stringed musical instrument such as a cello or bass violin. A feature of the adjustable support is a cylindrical shaft having a cylindrical inner cavity that defines a shaft wall thickness that promotes a circumferentially deformable shaft wall. An advantage of the adjustable support is that it is extensible from or insertable into the stringed instrument for easy transport. Another advantage of the adjustable support is that the entire cylindrical surface of the shaft is usable for establishing an elevation of the stringed instrument above a floor surface, the elevation being dictated by an artist playing the instrument.

Another object of the present invention is to provide an adjustable support that requires a relatively small amount of force upon a fastener from the artist playing the instrument to position the adjustable support such that the stringed musical instrument is elevated to a corresponding playing position for the artist. A feature of the adjustable support is a support member that provides substantially 360 degrees of inwardly-directed force upon the shaft via an axially parallel extending gap and a semi-circumferential aperture in a lower portion of a support member. An advantage of the adjustable support is that a balanced, circumferential gripping force is disposed upon the shaft to avoid bending the shaft and to maintain stability between the adjustable support and the elevated stringed musical instrument removably secured thereto.

Yet another object of the present invention is to provide an adjustable support that grasps a portion of a floor surface engaged by the shaft of the adjustable support. A feature of the adjustable support is a bottom portion of the shaft that includes rigid and deformable floor engagement members. Another feature of the adjustable support is the opposite and angularly positioned of the floor engagement members. An advantage of the adjustable support is that a smooth or carpeted floor surface is securely engaged by the shaft by rotating the shaft to position the required floor engagement member upon the floor surface. Another advantage of the adjustable support is that the selected floor engagement member is angled relative to the cello thereby orthogonally disposing the floor engagement member upon the floor surface and maximizing the grasp of the floor engagement member upon the floor surface.

Still another object of the present invention is to provide an adjustable support that is insertable into a variety of stringed musical instruments with varying aperture diameters in the bottom portion of the respective instrument. A feature of the adjustable support is a tapered or frustoconically configured stabilizing bushing having an axially parallel extending gap, the stabilizing bushing being disposed upon an insertion portion of the support member. An advantage of the adjustable support is that the tapered stabilizing bushing promotes a snug insertion of the support member into the aperture in the bottom portion of the instrument thereby removably securing and stabilizing the support member to the stringed musical instrument. Another advantage of the adjustable support is that the gap of the stabilizing bushing allows the stabilizing bushing to be inserted into the instrument until an annular wall of the support member engages the bottom portion of the instrument thereby maintaining and further stabilizing the elevated position of the stringed musical instrument upon the shaft.

Briefly, the invention provides an adjustable support for a stringed musical instrument comprising a shaft inserted into a predetermined portion of the stringed musical instrument; and a support member adjustably disposed upon said shaft; said support member comprising means for engaging a lower portion of the stringed musical instrument; means for engaging a peripheral portion of said shaft; and means for securing said support member to said shaft such that only an inner wall of said support member engages said peripheral portion of said shaft whereby an elevated position of the stringed musical instrument is maintained relative to a floor surface while maintaining tonal qualities of the stringed musical instrument when played.

The invention further provides a floor support for a hollow musical instrument comprising a cylindrical shaft inserted into a hollow portion of the musical instrument; and a support member disposed upon said shaft such that said support member engages and maintains the hollow musical instrument elevated above a floor surface, said support member including means for arcuately grasping an outer wall of said cylindrical shaft and means for adjusting the grasping force of said arcuate grasping means such that said force adjusting means do not engage said shaft.

BRIEF DESCRIPTION OF THE DRAWINGS

These and other objects, advantages and novel features of the present invention, as well as details of an illustrative embodiment thereof, will be more fully understood from the following detailed description and attached drawings, wherein:

FIG. 1*a* is a partial cut-away front elevation view of a hollow portion of a stringed musical instrument (cello) with an adjustable support removably secured thereto depicted in an inserted or transport position in accordance with the present invention.

FIG. 1*b* is the same view of FIG. 1 but with the adjustable support depicted in an extended or support position in accordance with the present invention.

FIG. 4*a* is a bottom plan view of the support member in an unsecured position relative to the shaft.

FIG. 4*b* is a bottom plan view of the support member in a secured position relative to the shaft.

DESCRIPTION OF THE PREFERRED EMBODIMENT

Figure 2:
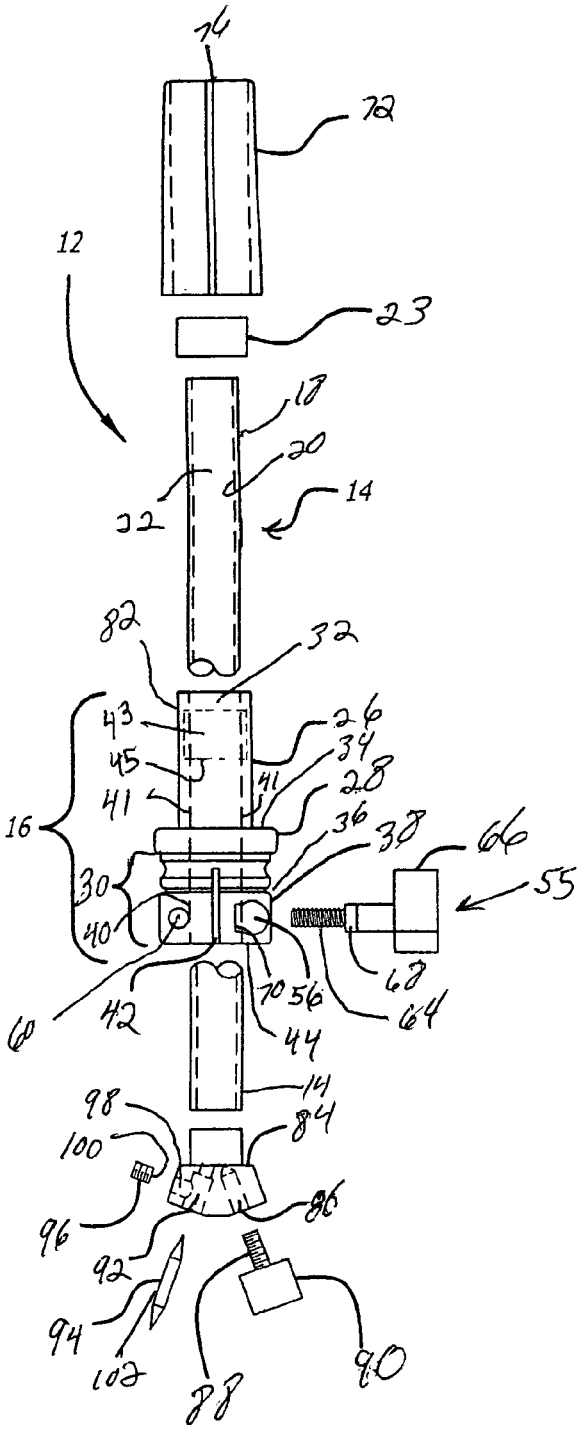
FIG. 2 is an exploded front elevation view of the adjustable support with a support member unsecured to a shaft in accordance with the present invention.

Referring now to the drawings, an adjustable support for a stringed musical instrument such as a cello 10 in accordance with the present invention is denoted by numeral 12. The adjustable support 12 includes a shaft 14 that is substantially aligned with the longitudinal axis of the cello 10. The shaft 14 is ultimately inserted into a hollow portion 13 of the cello 10 via an aperture (not depicted) in a lower portion 11 of the cello 10. Typically, the cello 10 is constructed to include a block 15 secured to an inner wall 17 in the lower portion 11 of the cello 10. The block 15 has an aperture that aligns with the aperture in the lower portion 11 of the cello 10 to promote the insertion of the shaft 14 into the hollow portion 13 of the cello 10. The shaft 14 is commonly of composite carbon or steel fabrication with a smooth outer surface that renders the shaft 14 subject to slippage in use. The slippage is advantageous when inserting the shaft 14 into the cello 10, but disconcerting to a performer playing the instrument should the cello 10 slide downward toward a floor and reduce an elevation preselected by the performer. The adjustable support 12 further includes a support member 16 preferably of metal, such as aluminum, or other moldable or machinable material such as plastic, elastomeric or synthetic composition. The support member 16 is adjustably disposed upon and secured to the shaft 14, and engages an outer planar wall of the lower portion 11 of the cello 10 to ultimately support the cello 10 at a preselected elevation relative to the physical stature of the performer.

The shaft 14 includes cylindrical outer and inner walls 18 and 20 that define an inner cylindrically configured cavity 22 with a predetermined diameter. The diameters of the outer and inner walls 18 and 20 cooperate to allow a relatively slight deformation of the shaft 14 when the support member 16 is secured to the shaft 14 thereby promoting congruent engagement between the outer wall 18 of the shaft 14 and an inner gripping wall 40 of the support member 16 resulting in increased gripping capability of the support member 16 upon the shaft 14. The shaft further includes a cap 23 disposed upon the end of the shaft 14 inserted into the cello 10. The cap 23 is preferably fabricated from rubber or elastomeric composition capable of preventing noise should the cap 23 forcibly engage the support member 16. Further, the cap 23 prevents the shaft 14 from resonating due to sound waves generated during the playing of the stringed musical instrument.

The wall thickness of the shaft 14 comprises a significant design feature in terms of the resultant quality of the music performed on the cello 10 or like stringed instrument. By enhancing the possible thinning of the wall thickness of the shaft 14, the present invention provides a slightly deformable shaft for enhanced grip of the support member 16 upon the shaft 14, and for enhanced tonal qualities of the instrument. A preferred wall thickness is less than 0.06 inches for a 0.5 inch diameter shaft fabricated from fiberglass or carbon fiber. Other materials such as metal will have corresponding preferred wall thicknesses.

The support member 16 includes an insertion portion 26 integrally joined to an annular portion 28, and a clamping or lower portion 30 integrally joined to the annular portion 28. The insertion portion 26 protrudes through the block 15 and into the hollow portion 13 of the cello 10 to provide support and stability for the cello 10 when a relatively snug fit exists between the insertion portion 26 and the block 15. The annular portion 28 includes an annular planar wall 34 having a diameter that facilitates sufficient surface area to engage and support the cello 10 should a stabilizing bushing 72, discussed infra, be sized to short. The insertion, annular and lower portions 26, 28 and 30 are cooperatively configured to provide a central aperture 32 therethrough that receives the shaft 14 and promotes the insertion of the shaft 14 through the support member 16 and into the cello 10. The central aperture 32 is defined by the gripping wall 40 through a lower part of the lower portion 30, and an adjacently disposed, slightly larger diameter, non-gripping wall 41 extending through the insertion portion 26, annular portion 28 and an upper part of the lower portion 30. The gripping wall 40 ultimately secures the support member 16 and cello 10 to the shaft 14. The non-gripping wall 41 and a centrally disposed guide member 43 of loop material or velcro fabric forcibly fitted into a recess 45 in the insertion portion 26, centrally disposes the shaft 14 through the support member 16 and into the cello 10.

The lower portion 30 includes an arcuate aperture 36 extending semi-circumferentially about the lower portion 30 and perpendicularly to the central axis of the central aperture 32. The arcuate aperture 36 extends from a cylindrical outer wall 38 of the lower portion 30 to a cylindrical inner wall 40 of the lower portion 30. The cylindrical outer and inner walls 38 and 40 longitudinally extend from the arcuate aperture 36 to a planar end wall 44 of the lower portion 36. The lower portion 30 further includes a gap 42 radially extending from the outer wall 38 to the inner wall 40, and extending parallel to a central axis of the lower portion 30 from the arcuate aperture 36 to the end wall 44 of the lower portion 30. The lower portion 30 also includes an axial aperture 46 disposed substantially opposite to the gap 42, the aperture 46 extending axially parallel and partially joined to the central aperture 32. The aperture 46 longitudinally extends from the end wall 44 to the arcuate aperture 36 thereby forming a "hinge" or flex portion 48 extending parallel to the central aperture 32 from the arcuate aperture 36 to the end wall 44 of the lower portion 30. The flex portion 48 allows a portion of the inner wall 40 of the lower portion 30 to be forcibly urged into engagement with a corresponding portion of the outer wall 18 of the shaft 14 resulting in the circumferential binding or 360 degree "grasping" of the inner wall 40 of the lower portion 30 upon the outer wall 18 of the shaft 14 without any contact between the shaft 14 and a securing fastener that would degrade tonal qualities of the cello 10. Thus, an elevated position of a stringed musical instrument can be maintained relative to a floor surface while maintaining tonal qualities of the stringed musical instrument when played.

The gap 42 in the lower portion 30 forms opposing first and second planar, parallel walls 52 and 54 that are initially separated a preselected distance that allows the support member 16 to slide upon the outer wall 18 of the shaft 14 until the support member 16 is disposed at a position corresponding to the required elevation of the bottom portion 11 of the cello 10 above the floor. The support member 16 is secured to the shaft 14 by reducing the distance separating the first and second walls 52 and 54 via a fastener 55 inserted through a first aperture 56 that extends from the first wall 52 to the outer wall 38 of the lower portion 30, the fastener 55 continuing through a second aperture 60 that extends from the second wall 54 to the outer wall 38 of the lower portion 30. The first and second apertures 56 and 60 are cooperatively configured and axially aligned, the second aperture 60 including a threaded inner wall that rotationally receives a correspondingly threaded portion 64 of the fastener 55. The fastener 55 includes a finger portion 66 that promotes the manually rotation of the fastener 55 to forcibly urge the threaded portion 64 of the fastener 55 into the second aperture 60 as a fastener washer or bushing 68 engages a planar bushing wall 70 annularly disposed about the first aperture 56. The continued rotational insertion of the fastener 55 into the second aperture 60 and the corresponding engagement of the fastener bushing 68 with the bushing wall 70, reduces the distance separating the first and second walls 52 and 54 while urging the inner wall 40 of the lower portion 30 into engagement with the outer wall 18 of the shaft 14 until the support member 16 is tightly secured to the shaft 14 thereby providing the required gripping force to maintain the selected elevated position of the stringed musical instrument above the floor surface.

Figure 3:
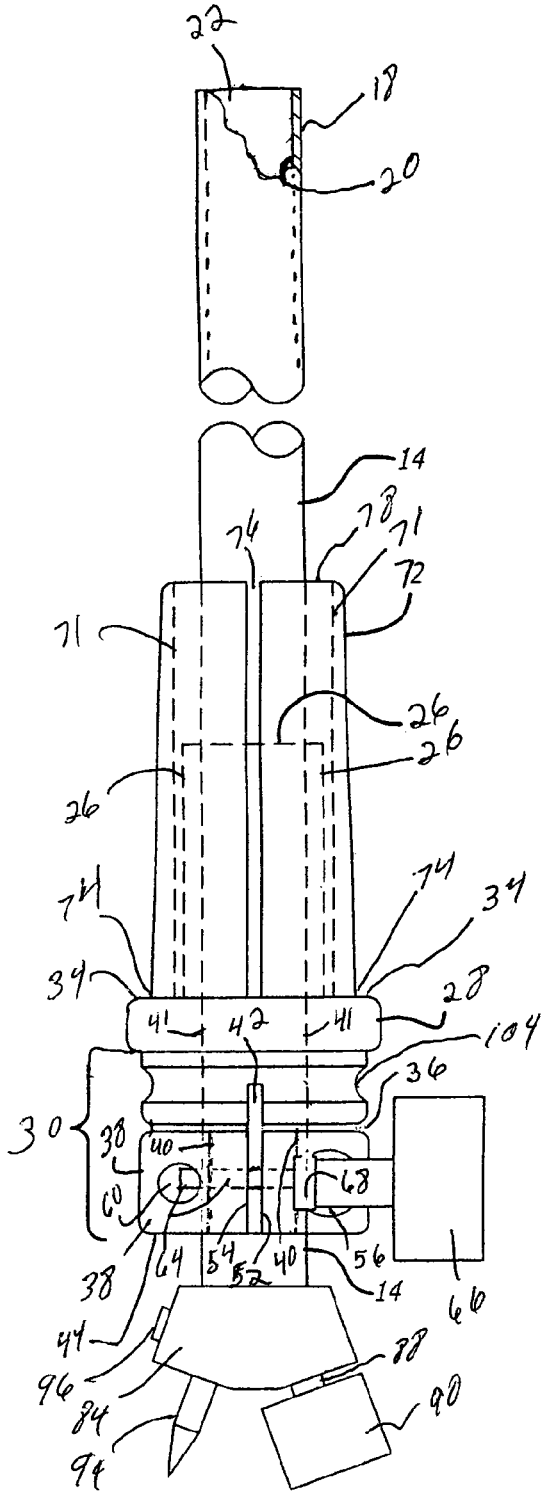
FIG. 3 is an enlarged front elevation view of the adjustable support with the support member secured to the shaft.

Referring now to FIG. 3, a support member 16 is depicted with the insertion portion 26 removably inserted into an aperture 71 in a stabilizing bushing 72. Without the bushing 72, the cello 10 would be allowed to "move" relative to the adjustable support 12. The stabilizing bushing 72 is fabricated from plastic or similar rigid material and includes an outer frustoconical configuration that promotes a relatively snug engagement between the insertion portion 26 and block 15 as the insertion portion 26 is urged inside the cello 10.

The preferred position of the stabilizing bushing 72 relative to the cello 10 is achieved by inserting the busing 72 into the aperture in the bottom portion 11 of the cello 10, then marking the visible portion of the bushing for cutting such that the bushing fits entirely with the cello 10 aperture when the insertion portion 26 together with the bushing 72 is forcibly disposed within the cello 10 aperture. The bushing 72 includes a discontinuity or gap 76 that is orientated parallel with the central axis of the bushing 72, the gap 76 extending from the outer end 74 to an inner end 78 of the bushing 72 thereby providing a slight movement for the bushing periphery to improve engagement between the insertion portion 26, bushing 72 and cello 10. If the bushing 72 has been cut correctly, the bushing 72 is entirely inserted into the cello 10 aperture. If the bushing 72 has not been cut correctly, the outer end 74 of the bushing will engage the annular wall 34 of the annular portion 28.

When the stabilizing bushing 72 is forcibly inserted into the block 15, the bushing 72 may become "seized" by the block 15 resulting in the bushing 72 remaining in the block 15 as the support member 16 is separated from the cello 10. To maintain engagement between the support member 16 and the bushing 72, a knurled surface is provided upon the outer cylindrical wall 82 of the insertion portion 26 thereby promoting the removal of the bushing 72 from the block 15 as the support member is separated from the cello 10.

The shaft 14 includes a bottom portion 84 having a first recess 86 disposed such that a central axis of the first recess 86 forms an acute angle with a central axis of the shaft 14. The first recess 86 removably receives, via a threaded insert 88 or similar rotational securing means, a deformable floor engagement member 90 for grasping a relatively smooth, non-deformable floor portion or protecting against damage to a floor covering. The deformable floor engagement member 90 is fabricated preferably of rubber or similar resilient "gripping" material that will maintain the position of the shaft 14 upon a "slick" floor surface or valuable rug at an angle to the floor corresponding to the acute angle formed by the central axes of the first recess 86 and the shaft 14. The bottom portion 84 has a second recess 92 disposed such that a central axis of the second recess 92 forms an acute angle with the central axis of the shaft 14. The second recess 92 removably receives a rigid floor engagement member 94 for grasping a deformable floor portion. The rigid floor engagement member 94 is fabricated preferably of metal or similar rigid material that will maintain the position of the shaft 14 upon a carpeted or wooden floor surface at an angle to the floor corresponding to the acute angle formed by central axis of the second recess 92 and the shaft 14. The rigid floor engagement member 94 is secured to the bottom portion 84 via a set screw 96 rotationally inserted into a threaded aperture 98 that disposes an end 100 of the set screw 96 into forceful perpendicular engagement with a side portion 102 of the rigid floor engagement member 94 to maintain the position of the member 94 relative to the bottom portion 84. An example of a rigid, removable floor engagement member 94 is a reversible double pointed spike.

The first and second recesses 86 and 92 are orientated relative to each other such that the selection of one of the deformable and rigid floor engagement members 90 and 94 for engagement with a floor surface separates the non-selected one of the deformable and rigid floor engagement members 90 and 94 from the floor surface thereby providing the musician a choice of engagement members for a given floor surface by simply by loosening the support member 16 and rotating the shaft 14 to select the appropriate member. The acute angles of the first and second recesses 86 and 92 promote the orthogonal disposition of the selected one of the floor engagement members 90 and 94 upon a floor surface to maximize resistance to slippage, while allowing the musician to eccentrically orientate the stringed musical instrument to a comfortable playing position.

An adjustable support 12 for a stringed musical instrument such as a cello 10 or similarly sized instrument in operation includes a capped end of a shaft 14 being slidably inserted through a support member 16. The capped end is then inserted through a lower portion 11 of the cello 10, and through a block 15 secured to an inner wall 17 in the lower portion 11 of the cello 10. A guide member 43 fabricated from a relatively soft, deformable, resilient material is centrally secured inside the insertion portion 26 to center the shaft 14 and maintain the position of the shaft 14 within the apertures that promote insertion of the shaft 14 into the hollow portion 13 of the cello 10.

To secure the support member 16 to the shaft 14 and maintain an elevated position of the cello 10 above a floor surface, a finger portion 66 of a fastener 55 is forcibly rotated to urge an inner wall 40 of a lower portion 30 into engagement with an outer wall 18 portion of the shaft 14 resulting in a substantially 360 degree inwardly-directed force provided by the shaft-surrounding support member 16. The circumferentially disposed force generated by the support member 16 requires only a relatively small amount of rotational force be applied to the finger portion 66 of the fastener 55 to secure the position of the support member 16 relative to the shaft 14 thereby maintaining a selected elevated position of the cello 10 above the floor surface. Further, the circumferentially disposed force avoids the bending of the shaft 14 through the application of an unbalanced force which is typical of a set screw, shoe or similar point contact member that would generate retention force by forcibly abutting against an outer surface of the shaft 14.

The shaft 14 is stabilized upon the floor surface by selecting either a deformable 90 or rigid 94 floor engagement member to orthogonally engage and sufficiently grip the floor surface while inclining the longitudinal axis of the cello to facilitate the comfortable playing of the instrument by the artist. The deformable 90 or rigid 94 floor engagement member is easily selected by simply loosening the grip of the support member 16 upon the shaft 14, and rotating the shaft 14 until the required floor engagement member is orthogonally disposed relative to the floor surface.

The support member 16 has a circumferentially disposed recess 104 about the lower portion of the support member 16 to receive a support string (not depicted) that secures a tail piece (not depicted) of the cello 10.

While this invention has been described with reference to its presently preferred embodiment, it is not limited thereto. Rather, the invention is limited only insofar as it is defined by the following set of patent claims and includes within its scope all equivalents thereof.

The invention claimed is:

1. An adjustable support for a stringed musical instrument comprising:

a shaft inserted into a predetermined portion of the stringed musical instrument; and a support member adjustably disposed upon said shaft;

said support member comprising:

means for engaging a lower portion of the stringed musical instrument;

means for engaging a peripheral portion of said shaft, said engaging means for a peripheral portion of said shaft includes a lower portion integrally joined to said annular portion, said lower portion comprising:

a central aperture axially aligned and cooperatively configured with said aperture through said annular portion, said central aperture promoting the insertion of said shaft through said lower portion;

an arcuate aperture perpendicular to the central axis of said central aperture, said arcuate aperture extending from an outer wall of said lower portion to an inner wall defining said central aperture, said arcuate aperture extending about substantially one-half the periphery of said lower portion;

a gap extending from said outer wall of said lower portion to said inner wall defining said central aperture, said gap extending from said arcuate aperture to an end of said lower portion; and a recess disposed substantially opposite to said gap, said recess extending parallel and partially joined to said central aperture thereby forming a flex portion of said lower portion extending parallel to said central aperture from said end of said lower portion to said arcuate aperture whereby a predetermined inner peripheral portion of said lower portion is forcibly urged into engagement with an outer peripheral portion of said shaft; and means for securing said support member to said shaft such that only an inner wall of said support member engages said peripheral portion of said shaft whereby an elevated position of the stringed musical instrument is maintained relative to a floor surface while maintaining tonal qualities of the stringed musical instrument when played.

2. The support member of claim 1 wherein said engaging means for a lower portion of the stringed musical instrument includes an insertion portion integrally joined to an annular portion, said insertion portion and said annular portion being cooperatively configured to provide an aperture therethrough to promote the insertion of said shaft into the stringed musical instrument.

3. The adjustable support of claim 1 wherein said shaft includes cylindrical outer and inner walls that define an inner cylindrically configured cavity with a predetermined diameter.

4. The adjustable support of claim 3 wherein said outer and inner wall diameters of said shaft cooperate to allow the deformation of said shaft thereby promoting congruent engagement between said outer wall of said shaft and said inner wall of said support member resulting in increased gripping capability of said support member upon said shaft.

5. The support member of claim 2 wherein said annular portion includes an annular planar wall for engaging an outer wall of the stringed musical instrument.

6. The support member of claim 1 wherein said securing means includes a gap radially extending from said outer wall of said lower portion to said inner wall defining said central aperture, said gap extending parallel to a central axis of said lower portion from said arcuate aperture to an end of said lower portion.

7. The support member of claim 6 wherein said securing means includes a first aperture extending through said first wall and out a first peripheral outer portion of said lower portion, and a second aperture extending perpendicular through said second wall and out a second peripheral portion of said lower portion, said first and second apertures being axially aligned and cooperatively configured to receive a fastener capable of adjusting the distance separating said first and second walls thereby providing the required gripping force of said support member upon said shaft to maintain the selected elevated position of the stringed musical instrument above the floor surface.

8. An adjustable support for a stringed musical instrument comprising:

a shaft inserted into a predetermined portion of the stringed musical instrument; and a support member adjustably disposed upon said shaft;

said support member comprising:

a bushing having an aperture for receiving said insertion portion of said support member, said bushing and said insertion portion being cooperatively coupled for insertion into an aperture in the predetermined portion of the stringed musical instrument;

means for engaging a lower portion of the stringed musical instrument, said engaging means for a lower portion of the stringed musical instrument includes an insertion portion integrally joined to an annular portion, said insertion portion and said annular portion being cooperatively configured to provide an aperture therethrough to promote the insertion of said shaft into the stringed musical instrument;

means for engaging a peripheral portion of said shaft; and means for securing said support member to said shaft such that only an inner wall of said support member engages said peripheral portion of said shaft whereby an elevated position of the stringed musical instrument is maintained relative to a floor surface while maintaining tonal qualities of the stringed musical instrument when played.

9. The support member of claim 8 wherein said bushing includes a frustoconical configuration for promoting snug insertion of said support member into the aperture in the predetermined portion of the stringed musical instrument.

10. The support member of claim 9 wherein said bushing includes a gap disposed parallel with a central axis of said bushing, said gap promoting the insertion of a preselected support member into a stringed musical instrument.

11. The adjustable support of claim 1 wherein said shaft includes a bottom portion having a first recess disposed such that a central axis of said first recess forms an acute angle with a central axis of said shaft, said first recess removably receiving a deformable floor engagement member for grasping a relatively smooth, non-deformable floor portion.

12. An adjustable support for a stringed musical instrument comprising:

a shaft inserted into a predetermined portion of the stringed musical instrument, said shaft includes a bottom portion having a first recess disposed such that a central axis of said first recess forms an acute angle with a central axis of said shaft, said first recess removably receiving a deformable floor engagement member for grasping a relatively smooth, non-deformable floor portion, said bottom portion includes a second recess disposed such that a central axis of said second recess forms an acute angle with said central axis of said shaft, said second recess removably receiving a rigid floor engagement member for grasping a deformable floor portion, said first and said second recesses being orientated such that the selection of one of said deformable and rigid floor engagement members for engagement with a floor surface, separates the non-selected one of said deformable and rigid floor engagement members from the floor surface; and a support member adjustably disposed upon said shaft;

said support member comprising:

means for engaging a lower portion of the stringed musical instrument;

means for engaging a peripheral portion of said shaft; and means for securing said support member to said shaft such that only an inner wall of said support member engages said peripheral portion of said shaft whereby an elevated position of the stringed musical instrument is maintained relative to a floor surface while maintaining tonal qualities of the stringed musical instrument when played.

13. The adjustable support of claim 12 wherein said selected one of said deformable and rigid floor engagement members is orthogonally disposed relative to the floor surface.

14. An adjustable support for a stringed musical instrument comprising:

a shaft inserted into a predetermined portion of the stringed musical instrument, said shaft includes a bottom portion having a first recess disposed such that a central axis of said first recess forms an acute angle with a central axis of said shaft, said first recess removably receiving a deformable floor engagement member for grasping a relatively smooth, non-deformable floor portion, said deformable floor engagement member is secured to said bottom portion via a threaded extension rotationally inserted into said first recess; and a support member adjustably disposed upon said shaft;

said support member comprising:

means for engaging a lower portion of the stringed musical instrument;

means for engaging a peripheral portion of said shaft; and means for securing said support member to said shaft such that only an inner wall of said support member engages said peripheral portion of said shaft whereby an elevated position of the stringed musical instrument is maintained relative to a floor surface while maintaining tonal qualities of the stringed musical instrument when played.

15. The adjustable support of claim 12 wherein said rigid floor engagement member is secured to said bottom portion via a set screw perpendicularly disposed to and engaging a side portion of said rigid floor engagement member.

16. The adjustable support of claim 14 wherein said shaft includes a cap for preventing said shaft from being pulled from the stringed musical instrument after insertion therein.

17. An adjustable support for a stringed musical instrument comprising:

a shaft inserted into a predetermined portion of the stringed musical instrument; and a support member adjustably disposed upon said shaft;

said support member comprising:

a circumferentially disposed recess for removably receiving a support string that is secured to a predetermined portion of the stringed musical instrument;

means for engaging a lower portion of the stringed musical instrument;

means for engaging a peripheral portion of said shaft; and means for securing said support member to said shaft such that only an inner wall of said support member engages said peripheral portion of said shaft whereby an elevated position of the stringed musical instrument is maintained relative to a floor surface while maintaining tonal qualities of the stringed musical instrument when played.

18. The adjustable support of claim 15 wherein said rigid floor engagement member includes a reversible double pointed spike.

19. The adjustable support of claim 17 wherein said shaft includes a wall thickness of less than 0.06 inches for a 0.5 inch diameter shaft.

20. The adjustable support of claim 17 wherein said support member includes means for arcuately grasping an outer wall of said cylindrical shaft and means for adjusting the grasping force of said arcuate grasping means such that said force adjusting means do not engage said shaft.

21. The support member of claim 20 wherein said grasping force adjusting means includes a radial gap in a lower portion of said support member, and means for adjusting said gap.

* * * * *